United States Patent [19]

Eisenmann et al.

[11] Patent Number: 5,056,994

[45] Date of Patent: Oct. 15, 1991

[54] HYDROSTATIC ROTARY PISTON MACHINE HAVING INTERACTING TOOTH SYSTEMS

[76] Inventors: Siegfried Eisenmann, Conchesstrasse 25; Hermann Härle, Conchesstrasse 23, both of D-7960 Aulendorf, Fed. Rep. of Germany

[21] Appl. No.: 427,236

[22] Filed: Oct. 24, 1989

[30] Foreign Application Priority Data

Oct. 24, 1988 [CH] Switzerland ..... 3943/88

[51] Int. Cl.[5] ..... F01C 1/10; F01C 17/02; F03C 2/08

[52] U.S. Cl. ..... 418/61.3

[58] Field of Search ..... 418/61.3

[56] References Cited

U.S. PATENT DOCUMENTS 3,106,163 10/1963 Mosbacher ..... 418/61.3
3,288,078 11/1966 Monroe et al. ..... 418/61.3
4,741,681 5/1988 Bernstrom ..... 418/61.3

FOREIGN PATENT DOCUMENTS 1173296 8/1984 Canada .
0043899 1/1982 European Pat. Off. .
1703573 11/1971 Fed. Rep. of Germany .
2752036 5/1979 Fed. Rep. of Germany .
3632155 3/1988 Fed. Rep. of Germany ..... 418/61.3

*Primary Examiner*—John J. Vrablik

[57] ABSTRACT

A hydrostatic rotary piston machine contains a displacement part acting as a driven part and an adjacent control part which serves to supply and removed operating fluid to and from the displacement part. The displacement part has a rigid housing with a first inner tooth system which interacts with a rotatable, eccentrically arranged rotary piston having a first outer tooth system. The rotary piston has a second inner tooth system which intermeshes with a second outer tooth system on a centrally mounted shaft which passes through the control part and is mounted at both ends. The difference is the number of teeth between the first inner tooth system and first outer tooth system is 1. The second inner and outer tooth system differ by at least two in the number of teeth, the outer tooth system always being that with the smaller number of teeth. A rotary commutator of the control part is coupled to the rotary piston via an arc gear having a transmission ratio of 1:1.

13 Claims, 8 Drawing Sheets

HYDROSTATIC ROTARY PISTON MACHINE HAVING INTERACTING TOOTH SYSTEMS

The invention relates to a hydrostatic rotary piston machine of the having a displacement part for providing output; a control part adjacent to the displacement part for supplying and removing operating fluid from the displacement part, the displacement part having a rigid housing with a first inner tooth system, a rotatable eccentrically arranged rotary piston with a first outer tooth system that intermeshes with the first inner tooth system, and a second inner tooth system; a centrally mounted shaft with two ends, that passes at least through the control part, having a second outer tooth system that intermeshes with the second inner tooth system; and mounting means for mounting the shaft at both ends.

BACKGROUND OF THE INVENTION

These hydrostatic machines can be used both as a hydraulic pump and, preferably, as a hydraulic motor and are particularly popular as low-speed "torque motors". Liquids and gases are used as the operating fluid. The particular advantage is a relatively large intake volume per revolution and hence a relatively high drive torque. These hydrostatic machines have the advantage that the shaft to the left and right of the displacement part and of the control part can be mounted in roller bearings having large dimensions, so that not only is there exact shaft mounting for the hydraulic part but a large bearing spacing, which permits high radial forces at the driven and output ends of the shaft, due to the considerable lever action of the shaft, is achieved. Not only is it possible to permit considerable belt and drive hub for hydrostatic wheel drives.

A known machine of this type (German Offenlegungsschrift 1,703,573) has a so-called rotor tooth system between the stationary housing and the outer tooth system of the rotary piston. This tooth system operates there as a displacement part. The rotary piston also has a rotor tooth system in its inner region, its inner rotor being connected nonrotatably, as a single piece, to the driven or output shaft. In this machine, an attempt is made to ensure that supply to, and removal from, the tooth system of the displacement part takes place via control slots which are arranged on the rotary piston itself. For reasons relating to design and gear kinematics the eccentricities of both rotor tooth systems must be identical. Thus, the tooth height of the tooth system of the displacement part depends on the tooth height of the very much smaller tooth system on the shaft, so that the delivery area, i.e. the specific volume per revolution of the tooth system of the displacement part, is still relatively small. Furthermore, the achievable flow cross-sections are disadvantageous owing to the commutator control envisaged there, so that there are high throttle losses.

OBJECT AND STATEMENT OF THE INVENTION

It is the object of the invention to provide a hydrostatic rotary piston machine of the stated type, in which the above-mentioned disadvantages do not occur. In particular, it is intended to increase the intake volume and to propose a hydrostatic rotary piston machine in which as many parts as possible can be produced by very highly efficient methods, for example by the sinter process. Furthermore, the number of parts required should be as low as possible. In particular, naturally axially moldable parts are sintered. This is achieved according to the invention by the combination of the following features.

The difference between the number of teeth of the first inner tooth system and the first outer tooth system is one, and the difference between the number of teeth of the second inner tooth system and the second outer tooth system is at least two, the outer tooth system in each case having the smaller number of teeth, and the control part having a rotary commutator and an arc gear with a transmission ratio of 1:1 for coupling the rotary commutator to the rotary piston.

According to the invention, twice the tooth height is in fact obtained in the tooth system of the displacement part, which system is referred to below as the first inner or outer tooth system, with a difference of one in the number of teeth, if the tooth system which is provided between the rotary piston and the shaft and which is referred to below as the second inner or outer tooth system, has a difference of more than one in the number of teeth. However, the resulting substantially greater intake volume of the tooth system of the displacement part requires intensive cross-sectional control per unit time (in $cm^2$/sec) of the inflowing and outflowing operating medium, and it is for this reason that a separate rotary commutator must be provided. Since the rotary piston transmits its torque to the shaft via very high tooth forces, this shaft must be very stable. Since this thick shaft must be passed through the rotary commutator, a new approach must be adopted for driving it by means of the rotary piston. This is also probably the reason why the specialists have so far considered a larger difference in the number of teeth as being impossible. This object is now achieved in an extremely advantageous manner if the second inner and outer tooth systems differ by at least two in the number of teeth, and if the rotary commutator of the control part is coupled to the rotary piston via a round-flank gear having a transmission ratio of 1:1. The rotary commutator is freely rotatable with respect to the shaft.

An inner tooth system having concave tooth flanks which are arc shaped and determine the shape of the tooth flanks of the second outer tooth system on the driven or output shaft by rolling on the second inner tooth system of the rotary piston is suitable as a possible tooth shape between the rotary piston and the shaft. Such an inner tooth system has particularly small glide components due to a very small pressure angle.

The efficiency of the inner gear between the rotary piston and the shaft can be further improved if the second inner tooth system (of the rotary piston) has convex circular tooth flanks and the shape of the tooth flanks of the second outer tooth system (of the shaft) is determined by rolling on the second inner tooth system and is thus concave. Thus, the notch-free cross-section of the rotary piston is also greater than in the case of the variant having concave flanks on the second inner tooth system, giving greater stability and permitting a narrower shape.

As is generally known for such machines, satisfactory rotary commutator control for supply to, and removal from, the displacement part requires that the rotary commutator executes exactly the same number of revolutions as the rotary piston around its own axis. Since the rotary piston executes not only a rotary movement but also an eccentric movement, this 1:1 tranmission gives rise to design difficulties. In the rotary piston machine according to the invention, this 1:1 transmission is achieved by virtue of the fact that the rotary commutator has gear extensions which point towards the displacement part and intermesh directly with the second inner tooth system of the rotary piston. The 1:1 transmission results from the fact that an arc gear having 1:1 transmission is provided between the rotary commutator and the rotary piston, in which gear the gear extensions projecting from the rotary commutator are in the form of teeth having round tooth flanks—distributed uniformly along an arc—and engage round teeth of the rotary piston as a second tooth system whose radius is smaller, by a factor corresponding to the eccentricity of the rotary piston machine, than the radius of the round tooth flanks of the gear extensions, or vice versa. High powers are not transmitted.

Conversely, the tooth system between the rotary piston and the output shaft must be in the form of a rolling tooth system with very small glide components in order to minimize losses. However, since the rotary commutator operates virtually torque-free, it can be driven using a gear with a relatively high glide component, as is the case for the arc gear. For example, a coupling as in the case of the cyclic gear may be provided. For the purposes of the invention, the content of U.S. patent application Ser. No. 427,233, filed Oct. 24, 1989 is incorporated herein by reference. In an embodiment of the second inner tooth system having concave teeth, the 1:1 drive of the rotary commutator is effected by virtue of the fact that the gear extensions of the rotary commutator which are distributed uniformly around the circumference directly engage the second inner tooth system of the rotary piston, which tooth system has concave circular tooth flanks, and the number of extensions is equal to the number of teeth of the second inner tooth system, the shape of the extensions being determined according to the guidelines for an arc gear in which the number of gear extensions is equal to the number of teeth of the second inner tooth system and having convex tooth flanks. For the constant 1:1 angular transmission from the rotary piston to the rotary commutator, a sufficient contact ratio can be achieved.

If the rotary piston has teeth with convex tooth flanks as a second tooth system, the rotary commutator is then driven by virtue of the fact that the gear extensions of the rotary commutator which are uniformly distributed around the circumference likewise directly engage the second inner tooth system of the rotary piston, which tooth system is provided with convex circular tooth flanks, and the number of extensions is equal to the number of teeth of the second inner tooth system, the extensions in turn being determined according to the guidelines for an arc gear as claimed in claim 6 and having concave tooth flanks.

In the case of similar rotary piston machines, which however are not of this type, it is known that the rotary commutator is driven by the rotary piston via a gyratory cardan shaft. However, this solution cannot be adopted for the machine according to the invention since, in the central region of the machine, the drive shaft is passed through the rotary commutator. It is true that it would be possible, in the region between the rotary commutator of the control part, to provide a gyratory hollow shaft which is provided at its two ends with a third or fourth outer tooth system which intermeshes at one end with a second inner tooth system of the rotary piston and at the other end with a third inner tooth system of the rotary commutator. However, this possibility cannot be adopted in practice since the driven or output shaft passed through in this region would have to be very much thinner, with the result that impermissible sagging of the gear shaft could occur for the same dimensions.

The embodiment of the tooth system of the displacement part, i.e. in this case the first inner or outer tooth system, has an important effect on the efficiency of the machine. Here, one of the sources of loss is the normal force with which the tips of the teeth of the first outer tooth system are pressed against the tips of the teeth of the associated inner tooth system. This tip tooth force is the smaller, the smaller the pressure angle of the tooth system. Since these tooth tips glide on top of one another, frictional losses occur there, which can also simultaneously lead to signs of wear. In an embodiment which has frequently proven its worth in practice, this first inner or outer tooth system is a trochoidal tooth system, and, as described in another context (see European Patent 43,899 the teeth of the first inner tooth system have approximately trapezoidal shape with convex flanks and tips, and the pitch circle of the first inner tooth system runs outside the circle about the midpoint of the first inner tooth system through the lower third of the tooth height of the first inner tooth system.

At high rotary speeds of these hydrostatic rotary piston machines, another embodiment which has proven useful is one in which the teeth of the first inner tooth system are formed by rollers rotatably mounted in the housing. These are mounted in the housing with certain play in the sliding bearings, so that a hydrodynamic sliding bearing is produced by the operating fluid between the roller and the housing.

In the type of rotary piston machines according to the invention, the rotary piston has an annular shape. The hydrostatic force acts on half its outer circumference and attempts to deform this annular element into an oval shape. This deformation must not be greater than permitted by the tooth play of the first inner tooth system if the rotary piston is still to rotate freely in the inner tooth system of the housing. If this oval deformation is too large, the rotary piston jams, resulting in poor efficiency and high wear in the machine. For this reason, the deformation rigidity of the rotary piston must be optimised. This is achieved when the inner tooth system of the rotary piston has the same number of teeth as its outer system, and when the rotary piston is produced from material having a high modulus of elasticity.

Other advantageous embodiments for efficient production of the machine according to the invention are described in the detailed description taken together with the drawings.

DESCRIPTION OF THE DRAWINGS

The invention is illustrated below for embodiments with reference to the attached, schematic drawings.

DETAILED DESCRIPTION OF EMBODIMENTS

Figure 1:
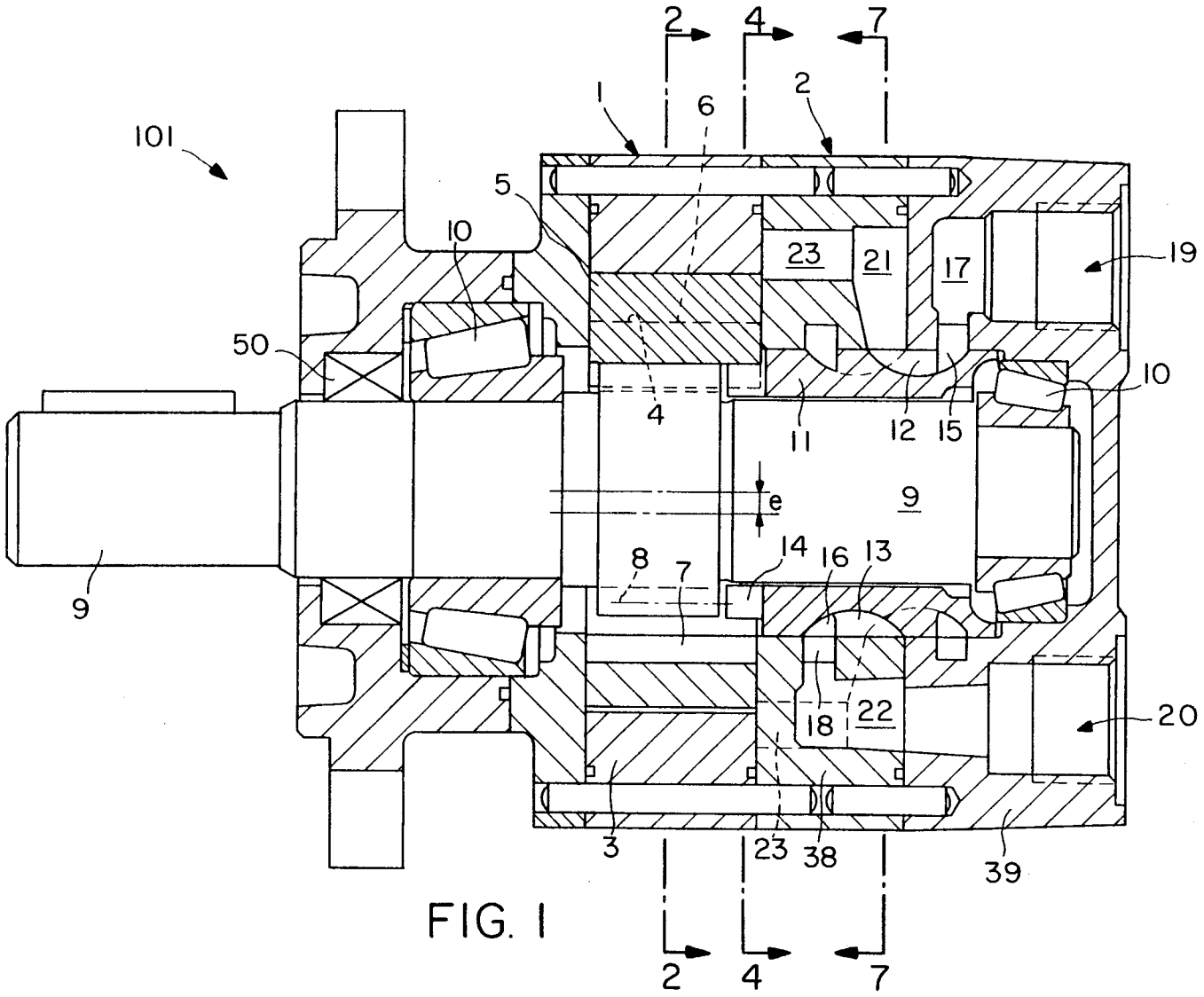
FIG. 1 shows a longitudinal section through an embodiment of a hydrostatic rotary piston machine, only the longitudinal pins but not the longitudinal screw unions being shown for the sake of greater clarity.

The rotary piston machine 101 shown in the figures has, in addition to the longitudinal screw union, not shown in the longitudinal cross-section, a driven or output shaft 9 which is mounted in a stable manner in two tapered roller bearings 10 to the left and right of the hydraulic part. The machine is provided with a leak-free seal with respect to the outside by means of a rotary shaft seal 50, the leak oil lines used for pressure relief in the seal and leak oil return lines in the low-pressure area not being shown, for the sake of clarity. The shaft 9 is provided with a powerful outer tooth system 8 (8*a* with convex and 8*b* with concave tooth flanks 28*a* and 28*b*, respectively) which transmits the drive torque or output torque and intermeshes with the inner tooth system 7 (7*a* with concave and 7*b* with convex tooth flanks 29*a* and 29*b*, respectively) of the rotary piston 5. The outer tooth system 8 has two less teeth the inner tooth system 7. This rotates with eccentricity e about the shaft 9 and, since the shaft is mounted coaxially with respect to the housing inner tooth system 4, also inside the housing 3. Thus, it is necessary to meet the design requirement that the axle spacing of the inner gear between shaft 9 and rotary piston 5 must be equal to the axle spacing of the inner gear between rotary piston 5 and housing 3. The machine furthermore has a drum-like rotary commutator 11 which is mounted in control part 2 so that the said commutator is pressure-tight but has play. In a radially outward direction, it has open control slots 12 and 13 which are alternately axially staggered and are distributed uniformly around the circumference. The control slots are connected to connections 19 and 20 for the delivery medium both via circumferential grooves 15 and 16 and via inner grooves 17 and 18. The mode of operation of such a rotary commutator for controlling, for example, a rotary piston machine of the type under discussion is known to the relevant skilled worker (cf. OMM Hydromotor of Danfoss) and therefore need not be explained in detail here. The OMM Hydromotor of the firm Danfoss corresponds to the disclosure in West German patent 2,752,036. The rotary commutator supplies pressure media to, and removes pressure media from, the displacement part 1 via the radial control channels 21 and 22 and via the axial channels 23.

As is evident from FIG. 2 to 6, the channels 23 enter the tooth spaces 26 of the housing inner tooth system 4, which, together with the associated outer tooth system 6 of the rotary piston 5, form the working spaces of the hydrostatic machine in a known manner. Furthermore, the mode of operation of these known internal gear-wheel pumps or motors is known to the skilled worker and needs no further explanation. When the flow of the operating medium to and from the working spaces 26*a* and 26*b* is correctly controlled by the rotary commutator 11, for example all working spaces 26*a* to the left of the interaxle line 40 are connected to feed 19, and all operating spaces 26*b* to the right of the said line are connected to the outflow 20. If, as in the case of a hydraulic motor, feed 19 is now under high pump pressure and the outflow 20 is approximately under atmospheric pressure, the rotary piston 5 is rotated in a clockwise direction at high torque about the engagement point 27 of the housing tooth system 4 in the example of FIG. 2. The magnitude and the uniformity of this torque depends decisively on the number of teeth and on the arc diameter of the outer tooth system of the rotary piston. This gives rise to a linear relationship between the intake volume of the machine per revolution of the rotary piston about its own axis and its torque. A large number of teeth and high eccentricity e thus give a high machine performance for a given installation space.

The rotary piston 5 now transmits its torque to the output shaft 9 in the form of high tooth force at engagement point 44 between its inner tooth system 7 and the outer tooth system 8 of the shaft.

Figure 2:
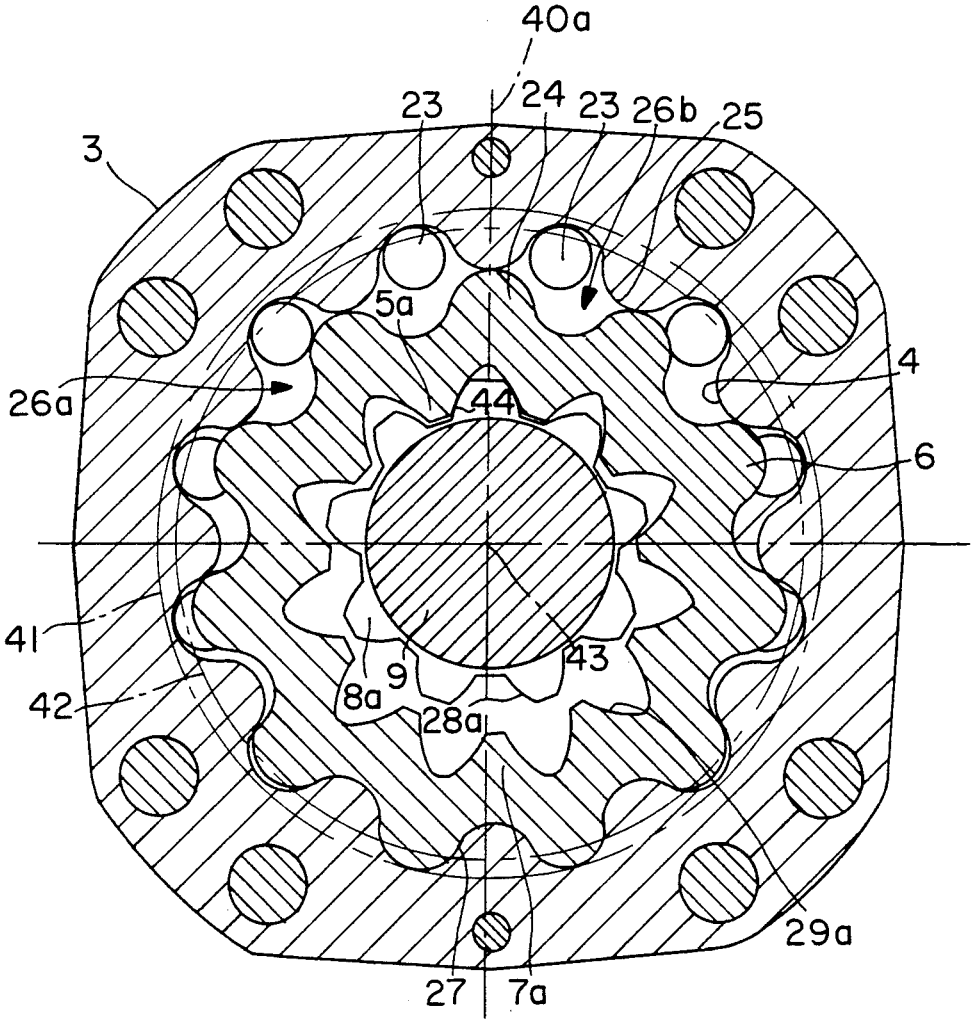
FIG. 2 shows a cross-section along the line 2—2 of FIG. 1, the inner tooth system of the rotary piston having concave tooth flanks.
Figure 3:
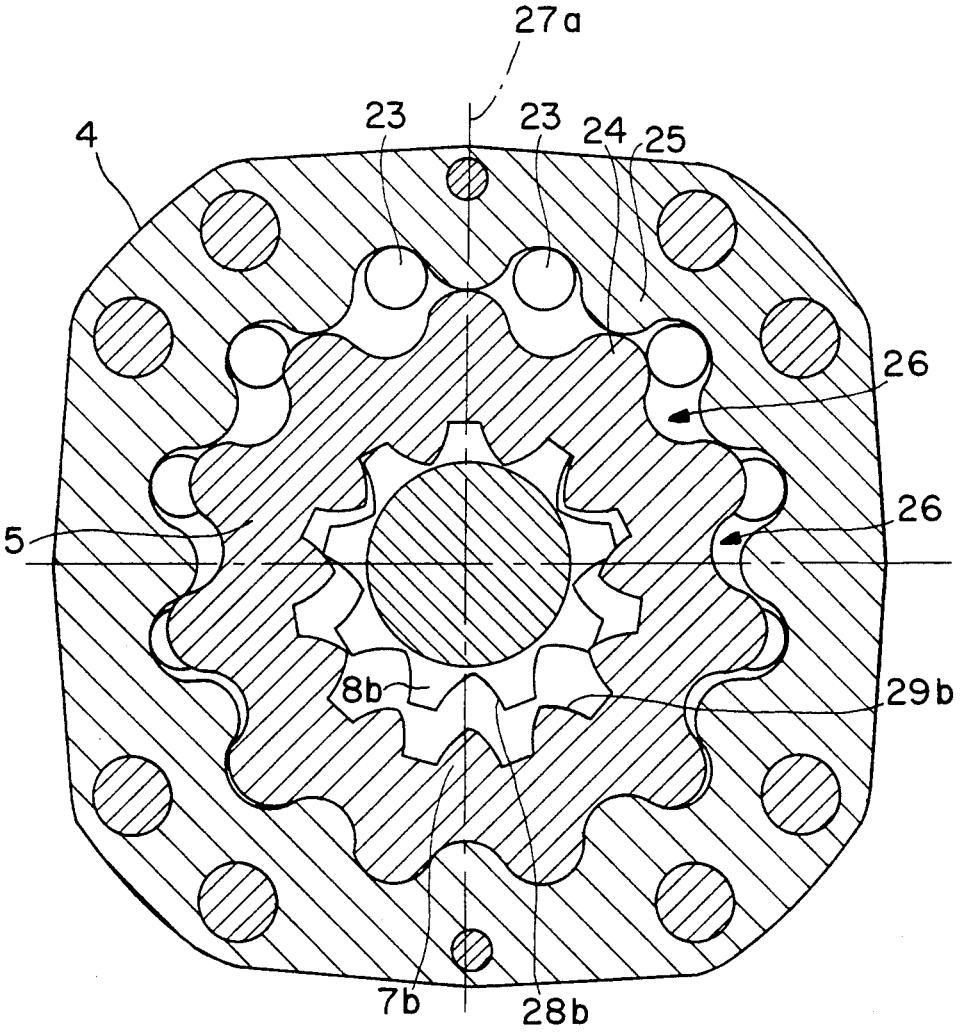
FIG. 3 shows an identical cross-section, the inner tooth system of the rotary piston having a convex tooth flank shape.
Figure 4:
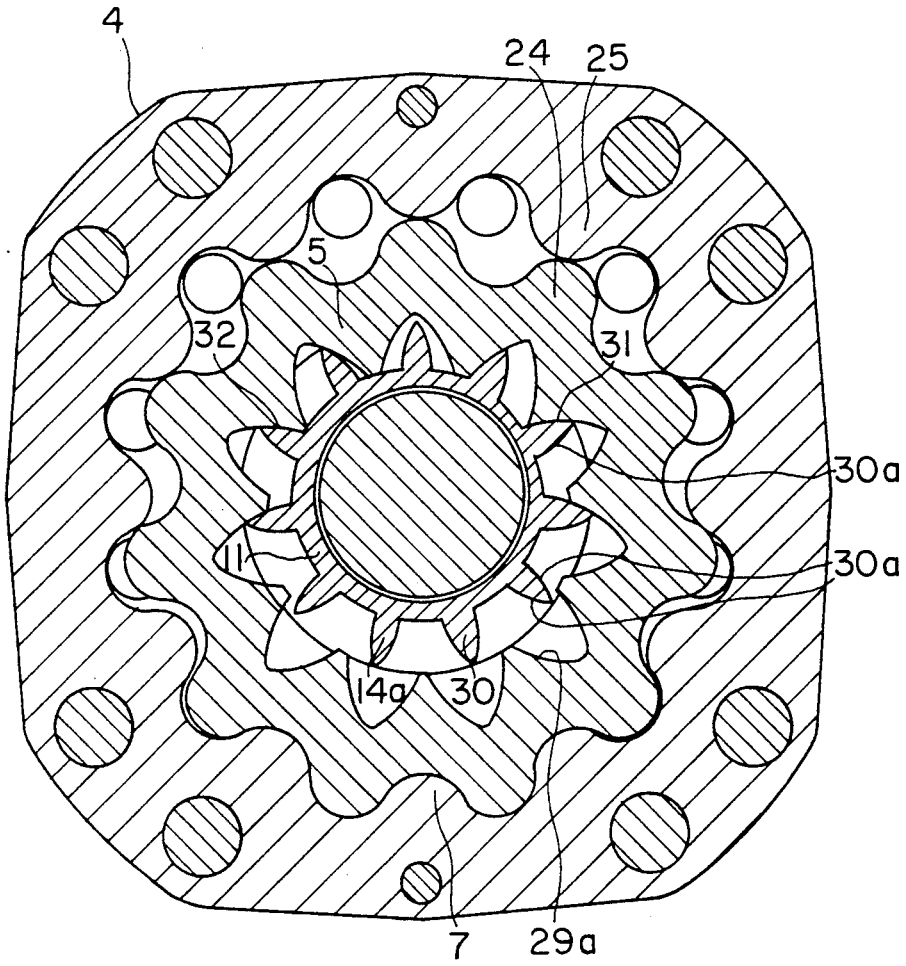
FIG. 4 shows a cross-section along the line 4—4 of FIG. 1, the inner tooth system of the rotary piston having concave tooth flanks as in FIG. 2.

The efficiency of this force transmission between the rotary piston and the shaft is influenced by the pressure angle of the engaged tooth systems. The tooth system according to FIG. 3 is about 4% superior to that of FIG. 2, provided that it has been optimized in terms of design. This optimization must be made on the drawing board and at the same time in computational terms, which need not be described in detail here and is known to the skilled worker.

What is important for successful operation of such a rotary piston machine is rigid shaft 9, and this is why the outer tooth system 8 which is preferably mounted on it as the single piece has as large a diameter as possible. At the same time, however, the rotary piston 5 should be as rigid as possible. It is evident in particular from FIG. 6 that it is advantageous if the inner tooth system of the rotary piston 5 has the same number of teeth as its outer tooth system 6.

As can be seen in particular in FIG. 1, little space is left for 1:1 drive of the rotary commutator 11 by the rotary piston 5. In the rotary piston machine according to the invention, a completely new approach has been adopted to achieve the object, as can be seen particularly clearly in FIG. 4. If an arc shape is selected for the inner tooth flanks 29*a* of the rotary piston 5, a suitable round tooth 30 (having a convex tooth flank 30*a*) can also be found for a 1:1 transmission between rotary piston 5 and rotary commutator 11. The active engagement points are designated by the numbers 31 and 32. The method for calculating and constructing this 1:1 tooth system is described in patent application Ser. No. 427,233, mentioned above. The extensions 14 in the form of teeth and having the round tooth flank 30*a* can be produced as one piece with the rotary commutator 11, for example by the sinter process. Since the rotary commutator consumes no power, the tooth load in this case is virtually zero.

Figure 5:
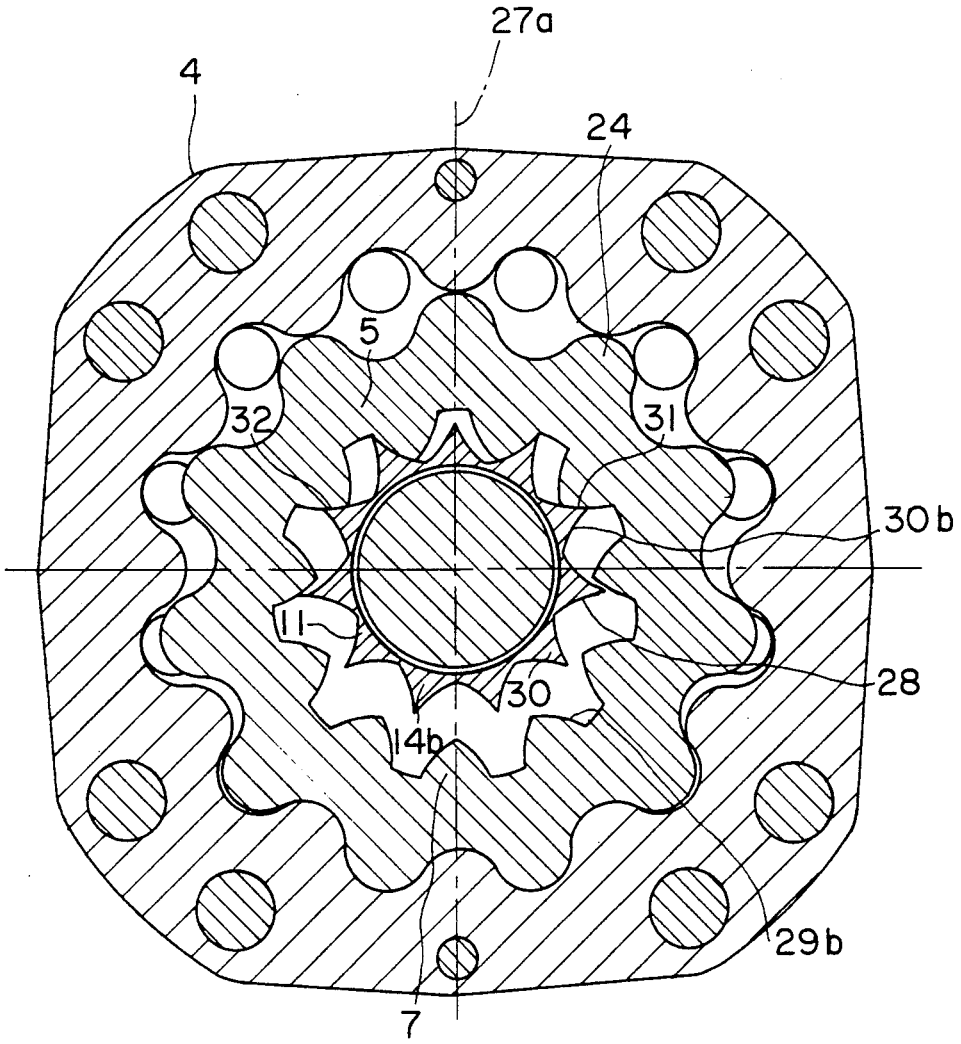
FIG. 5 shows an identical cross-section, the inner tooth system of the rotary piston having a convex tooth flank shape.

FIG. 5 shows such a round tooth system between the rotary piston 5 and the rotary commutator 11, in which the tooth shape 29 is convex. The rules of design and calculation for the counter-tooth flank 30*a* are identical. Substantially more stable tooth-shaped extensions 14*b* on the rotary commutator 11 are obtained here.

Figure 6:
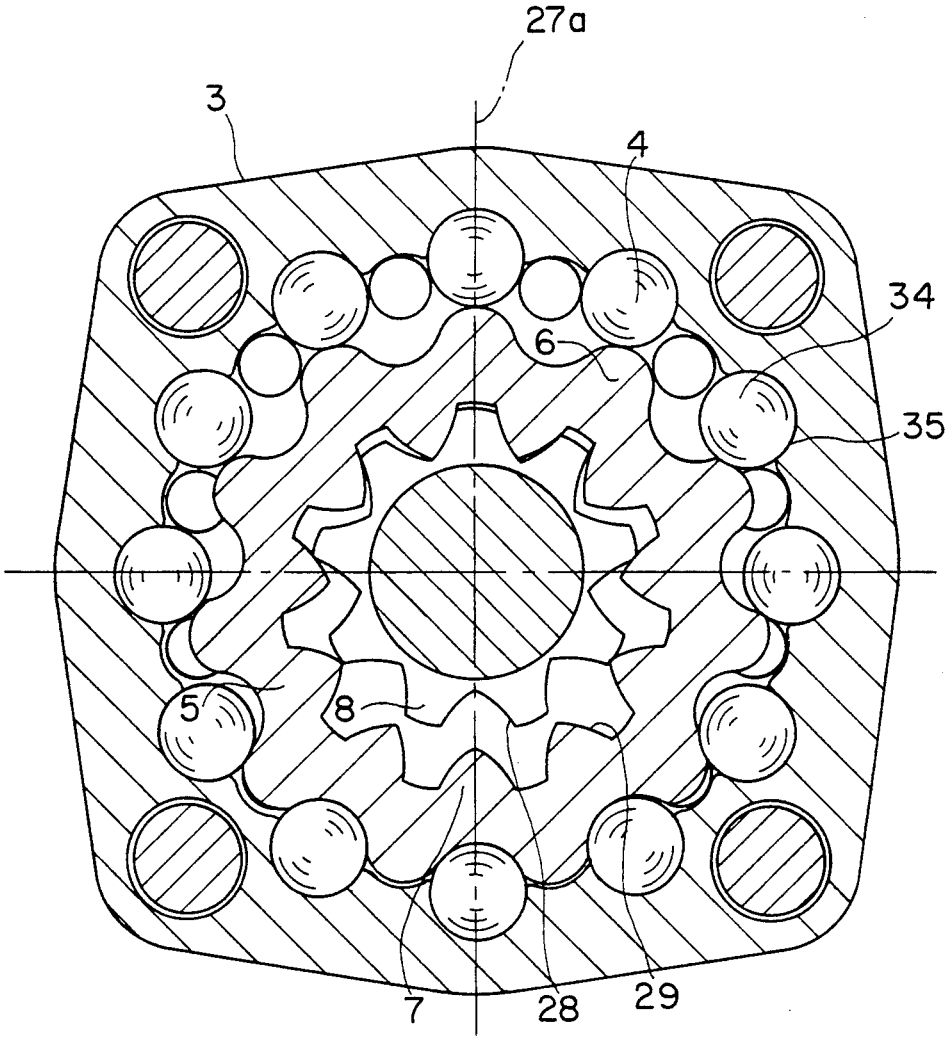
FIG. 6 shows a cross-section similar to the cross-section along the line 2—2 of FIG. 1, the inner toothing of the tooth system of the displacement part in the housing being formed by cylindrical rollers.

A machine having very high and proven resistance to wear is shown in FIG. 6, in which the inner tooth system 4 of the housing is produced from rotatable, hardened and ground rollers 34. Here, it is possible for the rollers 34 to be hydrodynamically mounted on an oil film in the gap 35 between roller and housing, so that the efficiency of this tooth system of the displacement part is improved. The manufacturing cost is of course correspondingly higher, since the lubricating film may be only a few micrometers thick, so that the internal shape of the housing must be just as exact.

Figure 7:
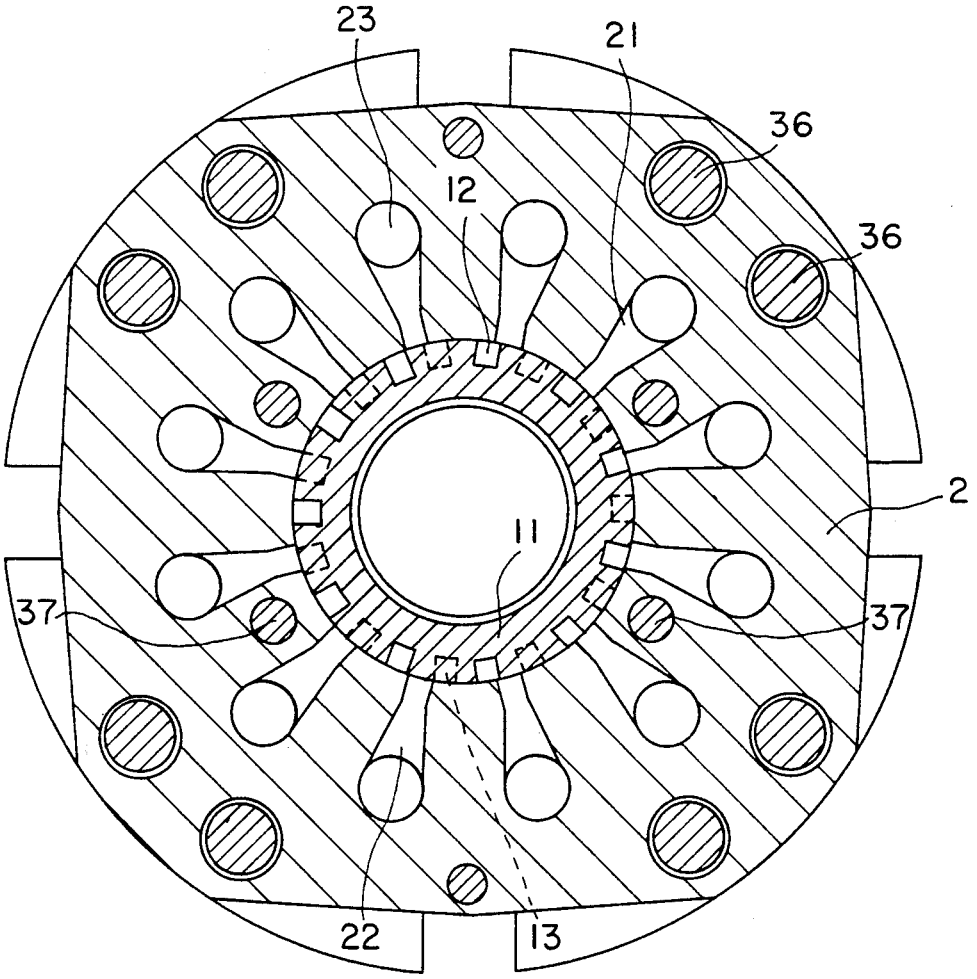
FIG. 7 shows a cross-section along the line 7—7 of FIG. 1.

FIG. 7 shows the arrangement of the radial slots 12 and 13 of the radial commutator 11, as well as the arrangement of the channels 21 and 22 and the cylindrical channels 23 in cross-section. Here, the screws 36 for the longitudinal screw union of the machine and the screws 37 for the separate screw connection of the control housing 38 with the connection housing 39 can also be recognized.

Figure 8:
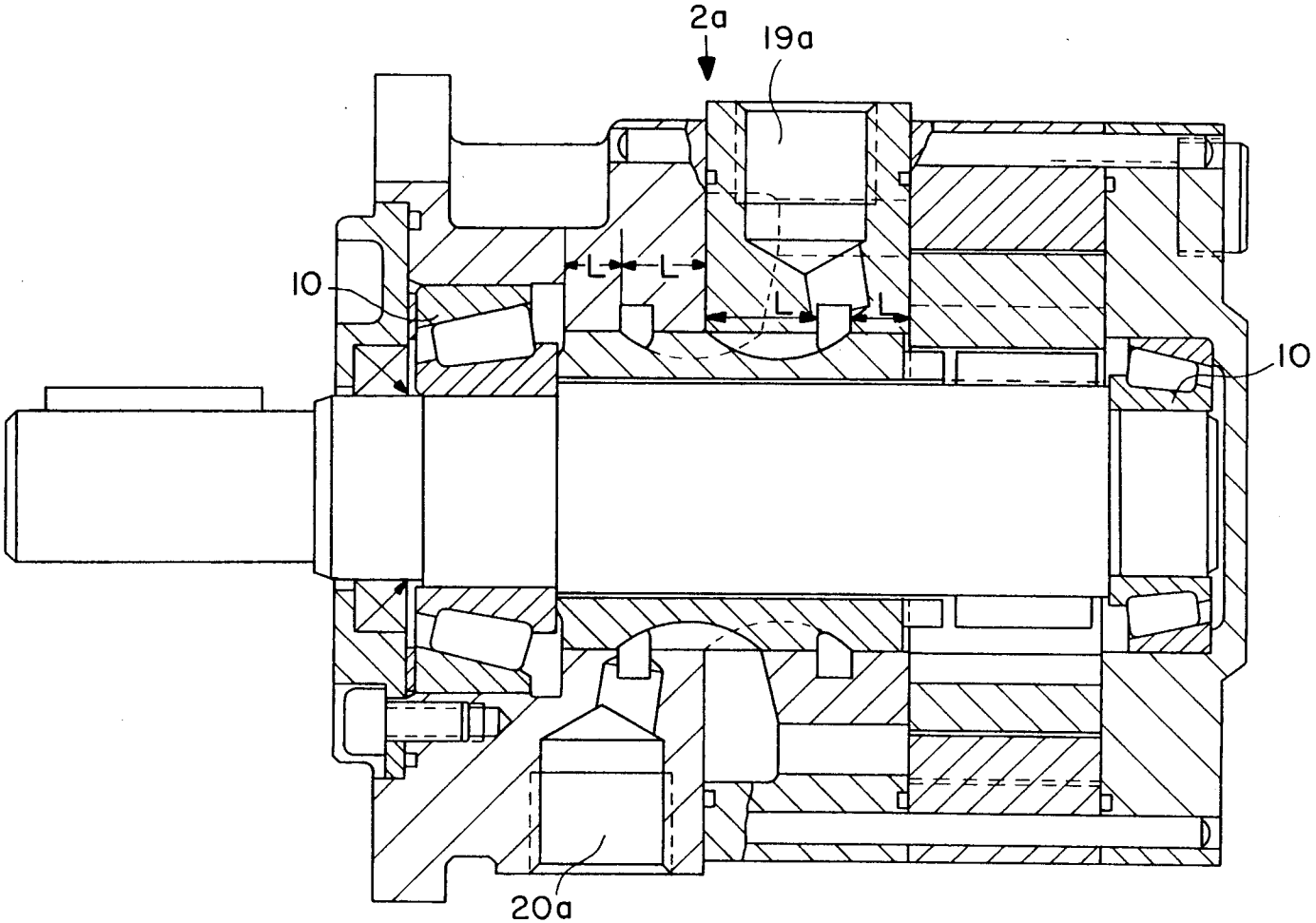
FIG. 8 shows a variant having a control part arranged in the center.

The variant shown in section in FIG. 8 illustrates the control part 2*a* with the connections 19*a*, 20*a* of the output end of shaft 9 in more detail than in the variant according to FIG. 1. This permits radial feed, and the radial bearing forces for bearing 10 are even better distributed. This furthermore results in less flow restriction losses at high rotary speed, because there are no pronounced path deflections; longer sealing zones "L" at the commutator and hence better volumetric efficiency with the same installed length as in FIG. 1; easier installation and an arrangement of the connections which conforms to market requirements. The other components correspond to those of the other Figures and are therefore not designated in detail.

The embodiments shown in the drawing are intended merely as examples of a rotary piston machine according to the invention. Thus, it is also possible for the flow through the rotary commutator to be axial instead of radial, as is preferable in some cases. Furthermore, the feed and discharge connections may be arranged radially instead of axially—as is often preferred.

We claim:

1. A hydrostatic rotary piston machine comprising a displacement part for providing output, a control part adjacent to the displacement part for supplying and removing operating fluid from the displacement part, the displacement part having a rigid housing with a first inner tooth system, a rotatable, eccentrically arranged rotary piston with a first outer tooth system that intermeshes with the first inner tooth system, and a second inner tooth system, a centrally mounted shaft with two ends, that passes at least through the control part, having a second outer tooth system that intermeshes with the second inner tooth system, and mounting means for mounting the shaft at both ends, wherein, the difference between the number of teeth of the first inner tooth system and the first outer tooth system is one, and the difference between the number of teeth of the second inner tooth system and the second outer tooth system is at least two, the outer tooth system in each case having the smaller number of teeth, the control part having a rotary commutator and an arc gear with a transmission ratio of 1:1 for coupling the rotary commutator to the rotary piston.

2. A hydrostatic rotary piston machine as claimed in claim 1, wherein the first inner tooth system is a trochoidal tooth system, each tooth of the first inner tooth system having an approximately trapezoidal shape with convex flanks and tips, and the first inner tooth system has a pitch circle that runs outside a circle about the arc centerpoint of the first inner tooth system through the lower third of its tooth height.

3. A hydrostatic rotary piston machine as claimed in claim 1 which comprises at least one of the following features:

a) the rotary piston, the housing and the rotary commutator are made of a sintered metal;

b) the second inner tooth system has the same number of teeth as the first outer tooth system, c) the teeth of the first inner tooth system are formed by rollers rotatably mounted in the housing, d) the rotary piston, the housing and the rotary commutator are made of a ceramic powder, and e) the rotary piston, the housing and the rotary commutator are made of a sintered metal and ceramic powder.

4. A hydrostatic rotary piston machine as claimed in claim 1, wherein, in the region of the rotary commutator, the control part is divided coaxially into a control housing and a connection housing and has a pressure-tight screw union.

5. A hydrostatic rotary piston machine as claimed in claim 1, wherein the shaft has an output transmitting power that is closer to the displacement part than to the control part.

6. A hydrostatic rotary piston machine as claimed in 1, wherein the second inner tooth system has concave tooth flanks, and the shape of the tooth flanks of the second outer tooth system on the shaft is determined for rolling on the second inner tooth system of the rotary piston.

7. A hydrostatic rotary piston machine as claimed in claim 6, wherein the rotary commutator has gear extensions that point towards the displacement part and intermesh directly with the second inner tooth system of the rotary piston, and the number of gear extensions is equal to the number of teeth of the second inner tooth system, the gear extensions having convex tooth flanks.

8. A hydrostatic rotary piston machine as claimed in claim 1, wherein the second inner tooth system has convex tooth flanks, and the shape of the tooth flanks of the second outer tooth system of the shaft is determined for rolling on the second inner tooth system.

9. A hydrostatic rotary piston machine as claimed in claim 8, wherein the rotary commutator has gear extensions which point toward the displacement part and intermesh directly with the second inner tooth system of the rotary piston, and the number of gear extensions is equal to the number of teeth of the second inner tooth system, the gear extensions having concave tooth flanks.

10. A hydrostatic rotary piston machine as claimed in claim 1, wherein the rotary commutator has gear extensions which point toward the displacement part and intermesh directly with the second inner tooth system of the rotary piston.

11. A hydrostatic rotary piston machine as claimed in claim 10, wherein the gear extensions projecting from the rotary commutator are in the form of teeth which are distributed uniformly along an arc, have round tooth flanks and engage the second inner tooth system, the radius of which is smaller, by a factor corresponding to the eccentricity of the rotary piston machine, than the radius of the round tooth flanks of the gear extensions, or vice versa.

12. A hydrostatic rotary piston machine as claimed in claim 11, wherein the number of gear extensions is equal to the number of teeth of the second inner tooth system, the gear extensions having concave tooth flanks.

13. A hydrostatic rotary piston machine as claimed in claim 11, wherein the number of gear extensions is equal to the number of teeth of the second inner tooth system, the gear extensions having convex tooth flanks.

* * * * *